US005495995A

United States Patent [19]

Dominique et al.

[11] Patent Number: 5,495,995

[45] Date of Patent: Mar. 5, 1996

[54] MOTOR DRIVEN HOSE REEL

[75] Inventors: Cecil G. Dominique, Fort Wayne; Edward L. Walter; Norman L. Franklin, both of Columbia City, all of Ind.

[73] Assignee: Reelcraft Industries, Inc., Columbia City, Ind.

[21] Appl. No.: 189,255

[22] Filed: Jan. 31, 1994

[51] Int. Cl.[6] ..... B65H 75/48

[52] U.S. Cl. ..... 242/390.1; 242/390.8

[58] Field of Search ..... 242/390.1, 390.8, 242/390.9; 137/355.2, 355.23

[56] References Cited

U.S. PATENT DOCUMENTS

| | | | |
|---|---|---|---|
| 2,573,868 | 11/1951 | Newell | 299/78 |
| 2,669,483 | 2/1954 | Fletcher | 299/78 |
| 2,918,809 | 12/1959 | Miller | 464/154 X |
| 3,098,463 | 7/1963 | Brown | 242/390.8 |
| 3,174,302 | 3/1965 | Pomper | 464/154 |
| 3,395,723 | 8/1968 | Tatsuno | 137/355.22 |
| 3,462,971 | 8/1969 | Kaufman et al. | 464/154 |
| 3,563,481 | 2/1971 | Stahmer | 242/54 |
| 3,625,450 | 12/1971 | Lloyd | 137/355.2 |
| 3,826,275 | 7/1974 | Courtright | 137/355.2 |
| 4,012,002 | 3/1977 | McDonald | 242/54 |
| 4,384,427 | 5/1983 | Christiansen | 242/390.9 |
| 4,494,710 | 1/1985 | Harris | 242/156 |
| 4,513,772 | 4/1985 | Fisher | 137/355.52 |
| 4,666,097 | 5/1987 | Tsuge et al. | 242/390.1 |
| 4,721,833 | 1/1988 | Dubay | 191/12.4 |
| 4,736,826 | 4/1988 | White | 191/12.2 |
| 4,787,569 | 11/1988 | Kanada et al. | 242/390.1 |
| 4,832,074 | 5/1989 | Li | 137/355.2 |
| 4,893,037 | 1/1990 | Schwartz | 310/68 |
| 4,993,449 | 2/1991 | Stutzman | 137/355.26 |

FOREIGN PATENT DOCUMENTS

| | | | |
|---|---|---|---|
| 2201778 | 9/1987 | Japan | 242/390.1 |

OTHER PUBLICATIONS

Winkler & Sundberg Brochure entitled "No Tension Hose Reels, Ergoreels" (no date available).

*Primary Examiner*—Daniel P. Stodola
*Assistant Examiner*—William A. Rivera
*Attorney, Agent, or Firm*—Baker & Daniels

[57] ABSTRACT

A reel assembly for carrying a flexible elongate member. The reel assembly includes a reel for connection to one end of the elongate member, a frame rotatably supporting the reel, an electric motor supported by the frame and rotatably driving the reel in a direction to retract the elongate member, and at least one sensor for sensing rotational movement of the reel. A control device interconnecting the sensor and the motor determines when the reel is rotated a first predetermined amount in a payout direction opposite the retraction direction, and, in response thereto, actuates the motor to drive the reel in the retraction direction through sufficient rotation to be capable of completely rewinding the elongate member. The control device further determines when the reel is rotated in the payout direction a second predetermined amount greater than the first predetermined amount and actuates the motor to drive the reel in the retraction direction through a third predetermined amount less than that necessary to completely rewind the elongate member.

12 Claims, 6 Drawing Sheets

50
52
60
DETERMINE DIRECTION
CW
CCW
YES
YES
68
62
63
78
82
SET
X = 1 TO 5
COUNTER
= X
NO
COUNTER
= Y
NO
YES
YES
64
70
SET
Y = X+6
78
72
(ON)
(OFF)
MOTOR
MOTOR
ON
CCW
PULSES
74
NO CCW PULSES
FOR 2 SEC.
66
MOTOR
OFF
CW
PULSES
NO CW PULSES
FOR 2 SEC.
YES
80
YES
TURN MOTOR ON
FOR X+2
CCW PULSES
76
TURN MOTOR
OFF
COUNT ≠
X+2
COUNT =
X+2
88
86
CHECK FOR NO
CCW PULSES
FOR 5 MIN.
NO
YES
90
84
MANUAL SWITCH
FOR MOTOR ON
TURN MOTOR
OFF

MOTOR DRIVEN HOSE REEL

BACKGROUND OF THE INVENTION

1. Field of the Invention

The present invention relates to a hose or electric cord reel, and, more particularly, to a motor driven hose reel.

2. Description of the Related Art

Reel assemblies for an elongate member, such as a fluid hose or electrical cord, may include an electric motor which rotatably drives a reel for rewinding of the elongate member on the reel. Examples of such reels are disclosed in U.S. Pat. Nos. 4,012,002 (McDonald et al), 4,513,772 (Fisher) and 4,832,074 (Li). A problem with such reels is that an electric switch connected to the motor is utilized for actuating the motor and thereby rewinding the hose on the reel. A user typically stands at the end of the hose during use of the hose for a specific application. Therefore, to rewind the hose, a user must return to the reel to actuate the electric switch, and cannot guide the hose toward the reel assembly, if desirable.

It is also known in the art to utilize a motor driven reel assembly which automatically completely rewinds a hose upon rotation of a predetermined amount in a payout direction of the reel. Alternatively, the motor may be actuated to completely rewind the reel utilizing a hand held remote control unit. Such an automatic reel is marketed by Winkler and Sunberg, Göteborg, Sweden under the trademark "ERGOREELS." More particularly, a proximity sensor is disposed adjacent to an end plate of the reel and is in communication with the electric motor. When the reel is rotated in the payout direction, the proximity sensor senses openings in the reel rotating therepast and sends corresponding pulses to a controller which actuates the motor. When the reel is rotated in the payout direction a predetermined amount, i.e., the proximity sensor is pulsed a predetermined number of times, the controller actuates the electric motor which attempts to rotate the reel in the retraction direction. Disposed between the electric motor and the reel, however, is a frictionally engaging clutch which allows the reel to slip therethrough as the reel rotates in the payout direction and the motor rotates in the retraction direction. When a desired amount of hose is withdrawn from the reel, a user holds the hose for a predetermined period of time. If the controller does not receive electrical pulses from the proximity sensor for a period of time greater than the predetermined period of time, the motor is turned off. The user can then use the hose for the desired application. To rewind the hose, a user withdraws the hose whereby the reel is again rotated in the payout direction the predetermined amount corresponding to the predetermined number of sensor pulses received by the controller to actuate the motor. A user may then simply release the hose or walk towards the reel assembly and the motor will continue to rewind the hose.

A disadvantage to the ERGOREELS motor driven reel is that the motor rotates in a direction opposite to the payout direction during payout of the hose, and a user must overcome the frictional force applied to the reel by the frictionally engaging clutch. The amount of force necessary to unwind the reel is therefore greater than necessary, and may result in undue physical stress and fatigue on a user during extended operation.

Another problem with the ERGOREELS motor driven reel is that if the hose is completely unwound in the payout direction and thereat used for a specific application, the reel cannot thereafter be further rotated in the payout direction to pulse the proximity sensor and energize the motor for rewinding of the hose. The user must then actuate the motor by utilizing the remote control unit or walking back to the reel assembly and manually actuating the motor. Utilizing the remote control has the disadvantages of requiring a user to separately carry the remote control, which is susceptible to physical damage.

Finally, the ERGOREELS motor driven reel includes an electric motor which is rigidly connected to a shaft which is attached to the reel and disposed coaxial with the axis of rotation of the reel utilizing a coupling which directly interconnects the motor output shaft and the reel shaft. The axial and radial alignment between the reel shaft and motor output shaft must therefore be within very close tolerances.

What is needed in the art is a motor driven hose reel which allows the motor to be actuated when the hose is completely unreeled from the reel, and which does not require a user to carry additional devices, such as a remote control.

A further need is a motor driven reel having a hose which can be unwound from a reel without exerting undue tension force against the hose caused by a coil spring or frictionally engaging clutch.

A still further need in the art is a motor driven reel having a motor output shaft and a reel shaft disposed substantially coaxial with each other, but which allows for radial and axial misalignment between the respective shafts.

SUMMARY OF THE INVENTION

The present invention provides a control device which interconnects two sensors and a motor, and which rotates the reel in a retraction direction through a predetermined amount less than that necessary to completely rewind the hose so that enough of the hose or cord always remains on the reel to permit activation of the motor by pulling on the hose or cord.

The invention comprises, in one form thereof, a reel assembly for carrying a flexible elongate member. The reel assembly includes a reel for connection to one end of the elongate member, a frame rotatably supporting the reel, an electric motor supported by the frame and rotatably driving the reel in a direction to retract the elongate member, and at least one sensor for sensing rotational movement of the reel. A control device interconnecting the sensor and the motor determines when the reel is rotated a first predetermined amount in a payout direction opposite the retraction direction, and, in response thereto, actuates the motor to drive the reel in the retraction direction through sufficient rotation to be capable of completely rewinding the elongate member. The control device further determines when the reel is rotated in the payout direction a second predetermined amount greater than the first predetermined amount and actuates the motor to drive the reel in the retraction direction through a third predetermined amount less than that necessary to completely rewind the elongate member.

The invention comprises, in another form thereof, a reel assembly for carrying a flexible elongate member. The reel assembly includes a reel for connection to one end of the elongate member, the reel including two end plates and a cylindrical member extending outwardly from one of the end plates. The cylindrical member is disposed generally coaxial with an axis of rotation of the reel. The reel assembly further includes a frame rotatably supporting the reel, an electric motor supported by the frame, and a coupling. The motor includes an output shaft disposed generally coaxial with the cylindrical member. The coupling is disposed generally coaxial with each of the reel axis of rotation and the motor output shaft, and drivingly interconnects the cylindrical member and the motor output shaft notwithstanding at least one of axial and radial misalignment between the cylindrical member and the motor output shaft.

An advantage of the present invention is that the motor can always be actuated to drive the reel in a retraction direction, without manually depressing a switch or using a remote control unit.

Another advantage is that the motor output shaft and reel shaft need not be in exact coaxial alignment to effect a rotatably driving connection therebetween.

Yet another advantage is that the hose may be unreeled from the reel without applying undue tension force to the hose.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
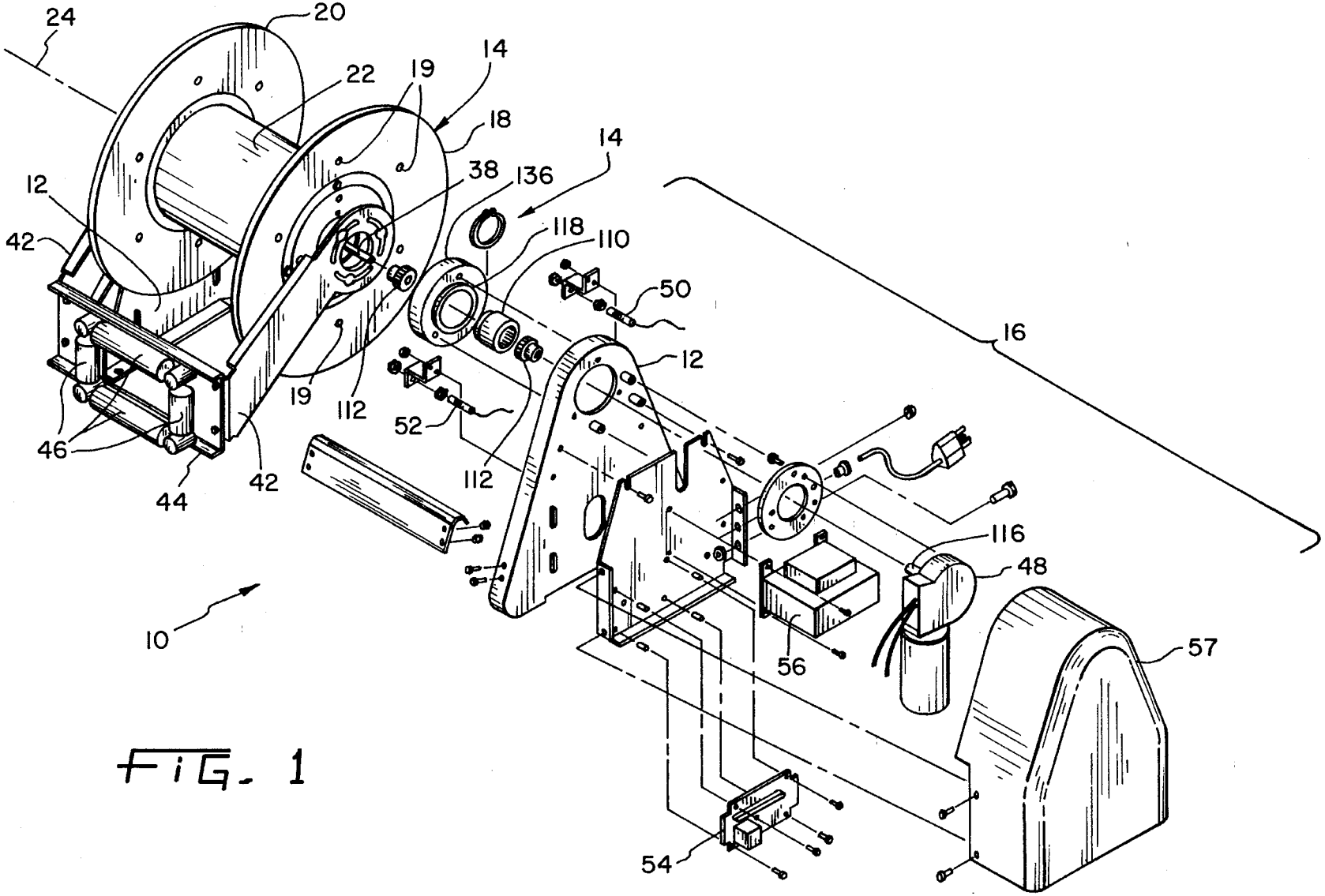
FIG. 1 is a partially exploded perspective view of an embodiment of the present invention.
Figure 2:
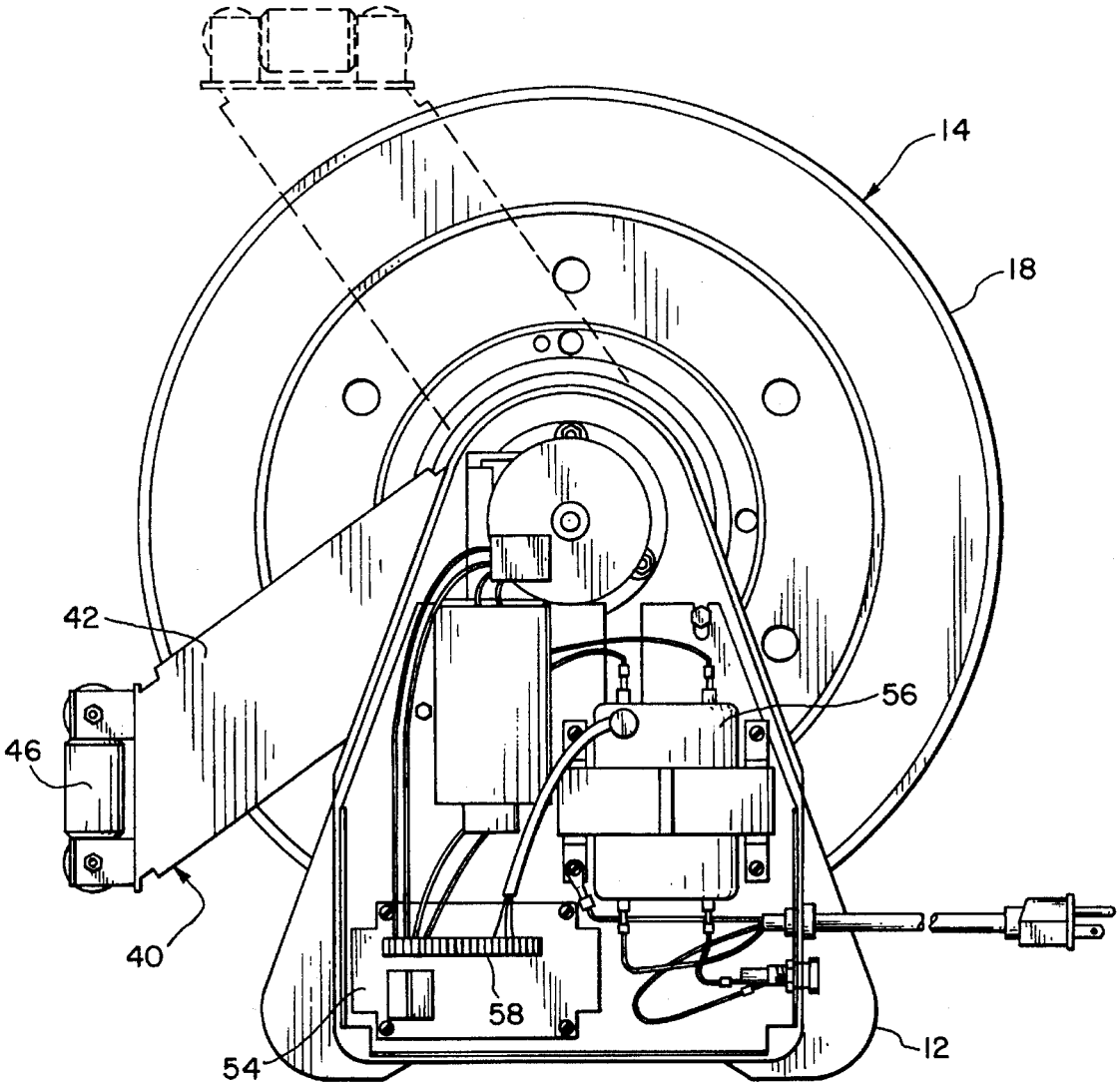
FIG. 2 is a side sectional view of the embodiment of FIG. 1.
Figure 3:
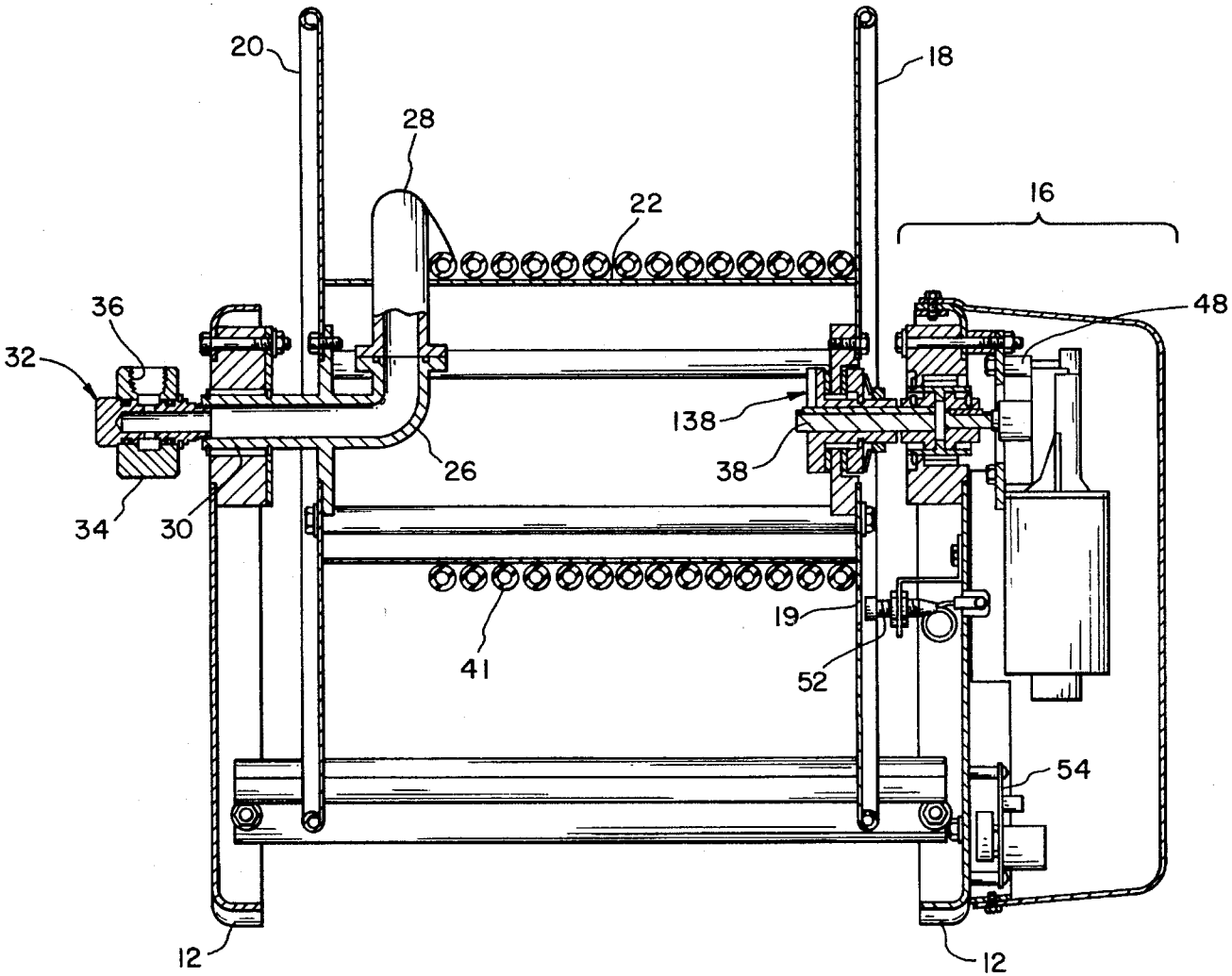
FIG. 3 is a front sectional view of the embodiment of FIGS. 1 and 2.

Referring now to the drawings, and particularly to FIGS. 1–3, there is shown a reel assembly 10 including a frame 12 supporting a reel 14 and motor assembly 16.

Reel 14 includes two endplates 18, 20 interconnected by a cylindrical member 22. Cylindrical member 22 includes a longitudinal axis defining an axis of rotation 24 of reel 14. Endplates 18, 20 respectively include a plurality of surface discontinuities, shown in FIG. 1 as holes 19, which are equidistantly spaced apart and radially spaced from axis of rotation 24. Referring to FIG. 3, a fluid coupling 26 is connected at a first end 28 thereof to the hose 41, and to a second end 30 thereof to a pressurized fluid source (not shown) utilizing a rotatable coupling 32 which is threadingly engaged with second end 30. Rotatable coupling 32 includes an outer collar 34 which, in known fashion, is rotatable relative to second end 30, and which is fluidly connected to the pressurized fluid source utilizing internal threads 36. Second end 30 of fluid coupling 26 is rotatably carried by frame 12 using a bearing assembly of conventional design. Disposed substantially coaxial with second end 30 and attached to plate 18 is a shaft 38 which is rotatably supported by frame 12 and rotatably driven by motor assembly 16, as described in more detail hereinafter.

A guide assembly 40 for guiding the hose during rewinding and payout of the hose 41 toward and away from reel 14, respectively, includes guide arms 42 and a cross piece 44 to which are rotatably attached a plurality of rollers 46. As shown in FIG. 2, guide assembly 40 is rotatable to a limited degree relative to frame 12 whereby the elongate member can be paid out or retracted in a plurality of desired directions.

Motor drive assembly 16 includes an electric motor 48, proximity sensors 50, 52 and control circuit 54 comprising a printed circuit board and discrete components mounted thereto. Motor assembly 16 may further include other components, such as a transformer 56. A housing 57 encloses electric motor 48 and control circuit 54 therein, and protects the same against physical damage.

Control circuit 54 electrically interconnects proximity sensors 50, 52 with electric motor 48. Control circuit 54 thus receives pulses from proximity sensors 50, 52 and provides output signals to electric motor 48 utilizing, e.g., a terminal block 58 shown in FIG. 2. In the embodiment shown in the drawings, control circuit 54 defines a control means for determining when reel 14 is rotated a first predetermined amount in a pay out direction and actuates the motor to drive the reel in a retraction direction through sufficient rotation to be capable of completely rewinding the elongate member. Control circuit 54 further determines when the reel is rotated in the pay out direction a second predetermined amount which is greater than the first predetermined amount and actuates the motor to drive the reel in the retraction direction through a third predetermined amount which is less than that necessary to completely rewind the elongate member.

Proximity sensors 50, 52 are each disposed adjacent to endplate 18 such that holes 19 rotate therepast. Utilizing the speed of rotation of reel 14 in either a pay out or retraction direction, and/or the time interval between pulses or pulse sequences provided by proximity sensors 50, 52 to control circuit 54, the direction of rotation of reel 14 may be determined.

Figure 4:
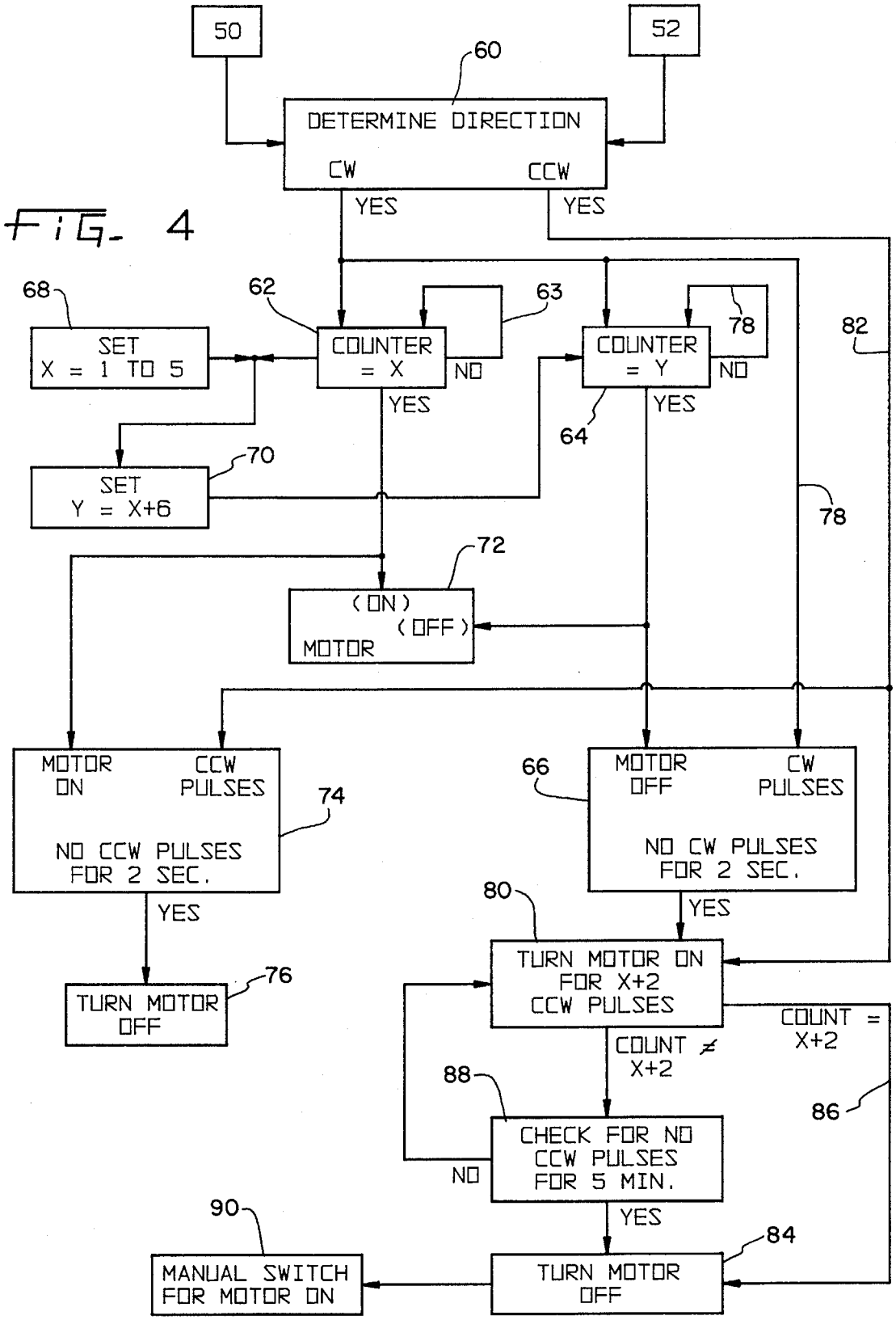
FIG. 4 is a flow chart illustrating control of the motor.

Referring now to FIG. 4, there is shown a flow chart illustrating the control algorithm which is carried out utilizing proximity sensors 50, 52, control circuit 54 and electric motor 48. Control circuit 54, of course, can be configured with hard wired circuitry or software and can be configured in many ways well known to those familiar with simple circuit design.

Upon rotation of reel 14, each of proximity sensors 50 and 52 provide output signals which are utilized in block 60 for determining whether reel 14 is rotating in a payout or retraction direction, as indicated above utilizing the speed of rotation of reel 14 and/or the time period between respective signal pulses provided by proximity sensors 50 and 52. For purposes of illustration, a payout direction is assumed to be a clockwise direction and is marked CW, and a retraction direction is assumed to be a counter clockwise direction and is marked CCW in block 60. If the direction of rotation is determined to be clockwise, corresponding pulses are transmitted to blocks 62, 64 and 66. In blocks 62 and 64, each time a pulse is received from block 60, COUNTER is increasingly incremented by 1. The value of COUNTER is compared with respective predetermined values X and Y. For example, in the embodiment shown in the drawings, control circuit 54 includes a selection jumper switch 100 which may be utilized to set the value of X from 1 to 5. The variable X therefore has a predetermined value as illustrated in block 68. The value Y is dependent upon the value X, and in the embodiment shown is set in block 70 to the predetermined value of X+6. Typical values for X and Y might include, e.g., 2 and 8, respectively.

Referring again to block 62, when the hose is first being paid out, the value of COUNTER will be less than the value of X and the control circuit awaits the next pulse, as indicated generally by loop 63 if a NO response is determined. Contrarily, if the value of COUNTER equals the value of X, a signal is transmitted for turning ON the motor, as indicated in blocks 72 and 74. Rotation of reel 14 in the clockwise direction at the point in time when the value of COUNTER equals the value of X corresponds to a first predetermined amount of rotation of reel 14. The motor would be turned on as indicated in block 72 if, e.g., a user pulled out the hose a sufficient distance corresponding to the first predetermined amount and desired to have the hose completely retracted in a counter clockwise direction. The motor is turned ON when COUNTER =X, and the user can drop the hose or walk toward the reel while holding the hose for rewinding of the same. When the hose is completely retracted, reel 14 stops rotating and no counterclockwise pulses are received by the control circuit, as indicated in block 74. In the embodiment shown, when no counterclockwise pulses are received for a period of two seconds, the motor is turned off as indicated in block 76.

Referring to block 64, the value of COUNTER is similarly incremented by one each time a pulse is received from proximity sensors 50, 52 via block 60. If the value of COUNTER does not equal the value of Y, a next pulse is waited for, as indicated generally by loop 78 if the determination is NO. On the other hand, if the value of COUNTER equals the value of Y, the motor which had been previously turned on is then turned off as indicated by blocks 66 and 72. Such a condition would occur, e.g., where the user does not give a short pull on the hose for turning on the motor and rewinding the hose, but rather continues to pull on the hose for use of the hose at a particular location for a specific application.

After the value of COUNTER equals Y and the motor is turned off, block 66 continues to receive clockwise pulses, as indicated by line 78. When payout of the hose is completed, i.e., a user reaches a particular location at which the hose is to be used, the hose is no longer unreeled and clockwise pulses are not received at block 66. When no clockwise pulses are received at block 66 for a period of 2 seconds, the motor is turned on and rotated in a counterclockwise direction as indicated in block 80. In the embodiment shown, the motor is turned on and the reel rotated in a counterclockwise direction for X+2 pulses received by one of proximity sensors 50, 52. The value of 2 added to the value of X provides a safety factor and is variable. To wit, assume for example that the hose is completely unreeled whereby an end-of-hose condition occurs. To subsequently actuate the motor by pulling on the hose (and without requiring a user to walk back to the reel for manual actuation of the motor), the reel must be rewound at least a predetermined amount which corresponds to a number of pulses to which the value of X is set in block 68. Thus, for example, if the value of X is set to 2, the motor must at least be rewound a predetermined amount corresponding to two pulses received by one of proximity sensors 50, 52. As a safety factor, however, the reel is rewound in a counterclockwise direction an amount corresponding to the number of pulses to which the value of X is set, plus an additional 2 pulses to ensure that a user can properly actuate the motor even when an end of hose condition occurs. As the reel is rewound in a retraction direction by the motor, the counterclockwise pulses provided by proximity sensors 50, 52 are utilized in block 80 as indicated by line 82.

When the motor is rewound a predetermined amount corresponding to X+2 counterclockwise pulses received by proximity sensors 50, 52, the motor is turned off in block 84, as indicated by line 86.

Block 88 comprises a safety feature in the event that the motor is turned ON to rotate in the counterclockwise direction an amount corresponding to X+2 pulses, but the reel is not able to turn in a counterclockwise direction for a particular reason. Such a condition may occur, e.g., when the hose is unreeled a particular length and thereat becomes caught on machinery or the like which prevents rotation of the reel in the counterclockwise direction. In such an event, the motor continues to attempt to drive the reel in a counterclockwise direction, and the frictionally engaging clutch 138 slips on the engaging surface of the reel. That is, the motor output shaft rotates in a counterclockwise direction, but the reel does not. To prevent the motor from being physically damaged under such a condition, block 88 determines whether a counter clockwise pulse has been received within a specific period of time after the motor is turned ON. In the particular embodiment shown, the motor is turned OFF if no counterclockwise pulses are received for a period of five (5) minutes.

Block 90 indicates that the motor may alternatively be turned on utilizing a manual switch located on the reel assembly. The manual switch may be necessary, e.g., if the hose is completely unreeled whereby an end-of-hose condition occurs, and the motor is not able to rewind the reel an amount corresponding to X+2 pulses and is turned OFF as indicated in blocks 88, 84. Moreover, if the hose is unreeled to a particular length and the user is standing adjacent to the reel assembly, it may be desirable to use a manual switch on the reel assembly for rewinding of the hose.

Figure 5:
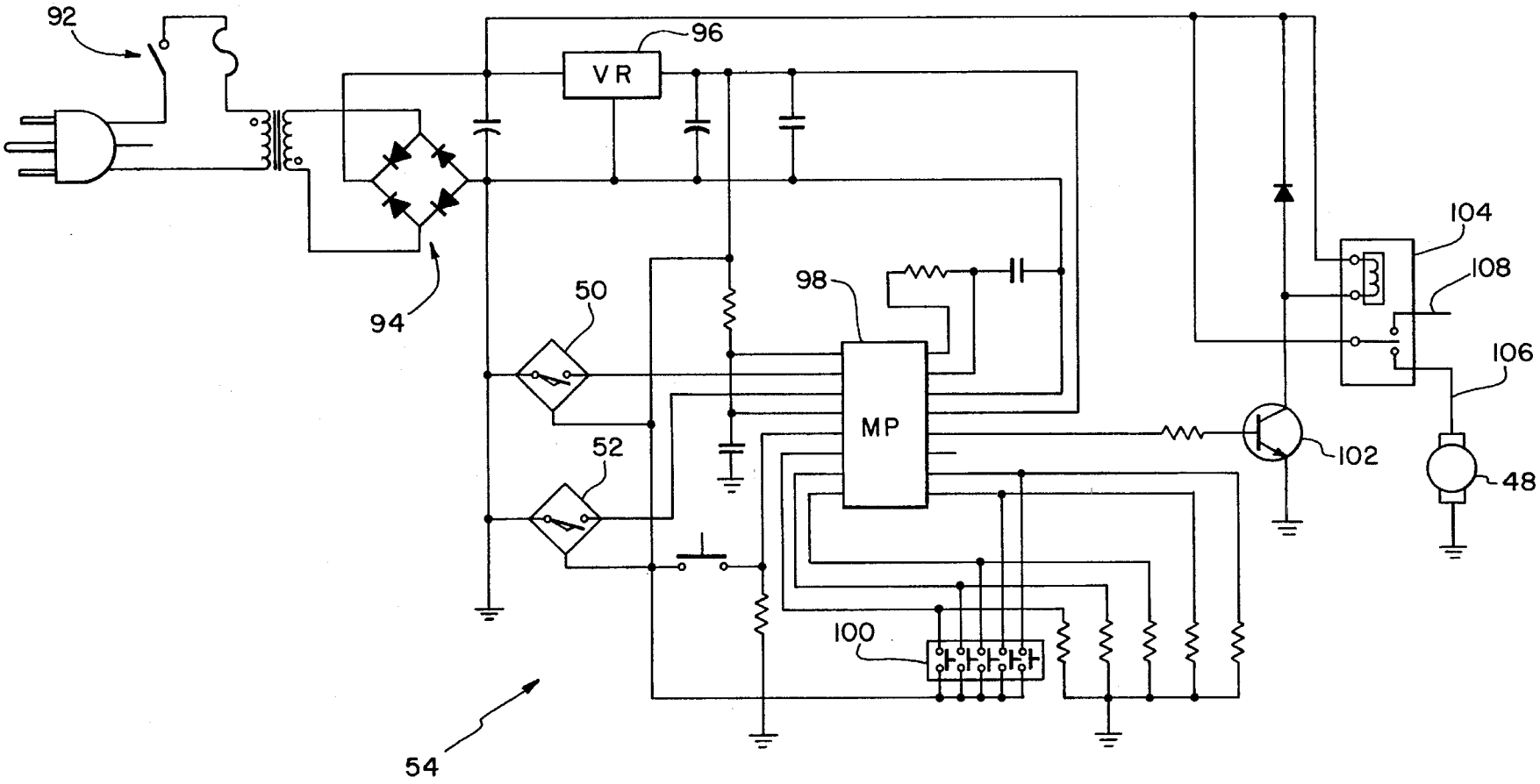
FIG. 5 illustrates one embodiment of an electrical schematic diagram implementing the flow chart of FIG. 4.
Figure 6:
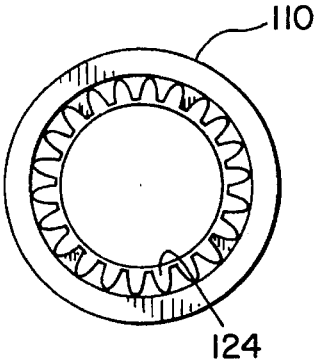
FIG. 6 is an end view of an internally geared collar of the coupling.

FIG. 5 is a schematic illustration of one embodiment of an electrical circuit of the present invention. The embodiment shown is only one example of a circuit for implementing the flow chart shown in FIG. 4 and other circuits are possible, including hard wire circuitry and/or software.

The circuit shown includes proximity sensors 50, 52 and electric motor 48 interconnected by a plurality of conventional electrical components. Particularly, the electrical components shown in FIG. 5 include an ON/OFF switch 92, rectifier 94, voltage regulator (VR) 96, microprocessor (MP) 98, jumper switch 100, NPN transistor 102 and relay 104.

Microprocessor 98, in the embodiment shown, comprises a Motorola (R) microprocessor, part number 68HC705K1.

Relay 104 includes two output terminals 106, 108 with terminal 106 being connected to motor 48 and terminal 108 comprising an extra terminal.

In accordance with another aspect of the invention, a coupling 114 (FIGS. 1 and 7) drivingly interconnects shaft 38 (FIGS. 1 and 3) and an output shaft 116 (FIGS. 1 and 7) of motor 48. Shaft 38 defines a cylindrical member. Coupling 114 includes an internally geared collar 110, externally geared member 112, race 118 and bearing elements 119.

Internally geared collar 110 may be made from any suitable material, such as metal or plastic, and includes first and second internally geared portions 120, 122 separated by a transverse wall 124.

Figure 8:
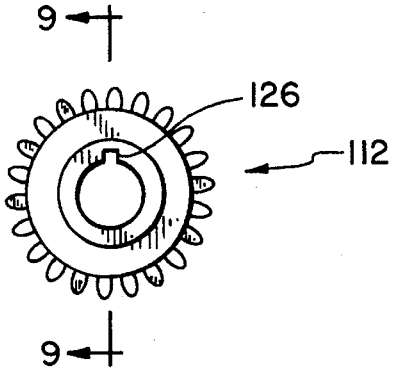
FIG. 8 is an end view of an externally threaded gear of the coupling.
Figure 9:
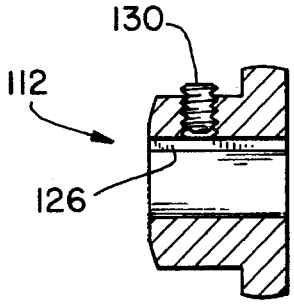
FIG. 9 is a sectional view of the externally threaded gear of FIG. 8, taken along line 9—9.

Externally geared member 112 includes a keyway 126 (FIG. 8) allowing externally geared member 112 to be attached to either of motor output shaft 116 or shaft 38 utilizing a key 128 and set screw 130. FIG. 1 illustrates two externally geared members 112 which are respectively connected to motor output shaft 116 and shaft 38.

Externally geared members 112 are sized to loosely fit within internally geared member 110, whereby radial misalignment of motor output shafts 116 and shaft 38 is accommodated. Moreover, as is apparent from FIG. 7, externally geared member 112 need not be at an exact axial location within internally geared collar 110. Rather, as long as the external teeth of externally geared member 112 engage the internal teeth of internally geared collar 110, rotational motion is transmitted from motor output shaft 116 to shaft 38 of reel 14.

Race 118 is disposed radially around internally geared collar 110. A pair of grooves 132 are formed in internally geared collar 110, and retaining rings, one of which is numbered 134, prevent excess relative movement in an axial direction between race 118 and internally geared collar 110. Referring to FIG. 1, race 118 may be disposed within a housing 136 which in turn is fastened to frame 12.

Figure 7:
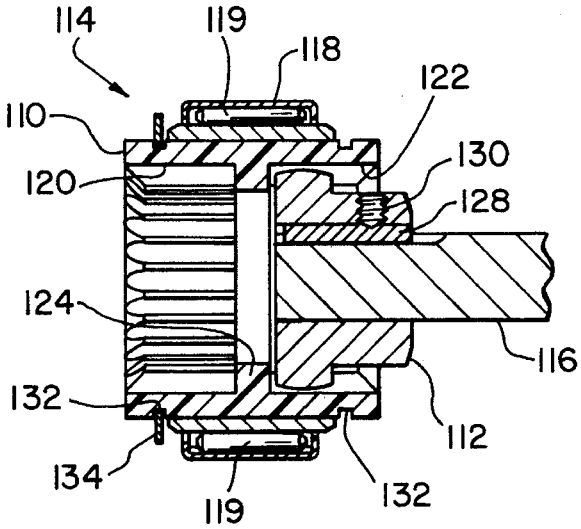
FIG. 7 is a sectional view of an embodiment of the coupling of the present invention.

Referring to FIG. 7, bearing elements 119 are disposed between race 118 and internally geared collar 110, and allow a relatively free rotational movement therebetween. In the embodiment shown, bearing elements 119 comprise roller bearing elements.

The embodiment illustrated in the drawings utilizes a loosely fitting coupling 114 to accommodate axial and radial misalignment between motor output shaft 116 and shaft 38. However, use of a different kind of a coupling accommodating axial and radial misalignment is possible, such as a flexible coupling.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reel assembly for carrying a flexible elongate member, said reel assembly comprising:

a reel for connection to one end of the elongate member;

a frame rotatably supporting said reel;

an electric motor supported by said frame and rotatably driving said reel in a direction to retract the elongate member;

at least one sensor for sensing rotational movement of said reel; and control means interconnecting said sensor and said motor for determining when said reel is rotated a first predetermined amount in a payout direction opposite the retraction direction and in response thereto actuating said motor to drive said reel in the retraction direction through sufficient rotation to completely rewind the elongate member, said control means further determining when said reel is rotated in said payout direction a second predetermined amount greater than said first predetermined amount and payout has stopped and actuating said motor to drive said reel in the retraction direction through a third predetermined amount less than that necessary to completely rewind the elongate member.

2. The reel assembly of claim 1, wherein said first predetermined amount is variably set by the user.

3. The reel assembly of claim 2, wherein said control means includes a selection switch, said first predetermined amount is set by activating said switch.

4. The reel assembly of claim 1, wherein said reel includes two end plates interconnected by a cylindrical member defining an axis of rotation, one of said end plates including a plurality of surface discontinuities thereon radially spaced from said axis of rotation, said sensor disposed adjacent said one end plate whereby said plurality of surface discontinuities rotate therepast upon rotation of said reel.

5. The reel assembly of claim 4, wherein each said sensor provides a plurality of signal pulses corresponding to one of a presence and absence of one of said plurality of surface discontinuities adjacent to said sensor, said control means receiving said signal pulses, said first predetermined amount corresponding to a number of said signal pulses received by said control means.

6. The reel assembly of claim 4, wherein said surface discontinuities comprise openings in said one end plate.

7. The reel assembly of claim 1, wherein said sensor comprises two sensors for determining the direction of rotation of said reel.

8. A reel assembly for carrying a flexible elongate member, said reel assembly comprising:

a reel for connection to one end of the elongate member;

a frame rotatably supporting said reel;

an electric motor supported by said frame and rotatably driving said reel;

at least one sensor for sensing rotational movement of said reel;

control means connected to said at least one sensor for determining when an end of elongate member payout condition occurs, said condition corresponding to a condition wherein the elongate member is no longer being unreeled from said reel and rotation of said reel has stopped; and means responsive to said end of payout condition for automatically actuating said motor to rewind said reel in a direction opposite said one direction in an amount less than that necesary to completely rewind said member.

9. The reel assembly of claim 8, wherein said elongate member comprises a hose, and wherein said reel assembly is adapted for connection to a pressurized fluid source.

10. The reel assembly of claim 8, wherein said elongate member comprises at least one of a fluid hose and an electrical cord.

11. The reel assembly of claim 8, wherein said control means includes said actuating means.

12. The reel assembly of claim 8 wherein said control means determines when said reel is rotated a predetermined amount in the payout direction greater than an amount required to reach the payout condition and deactivate said motor until payout has terminated.

* * * * *